US006417615B1

(12) United States Patent
Yasuda et al.

(10) Patent No.: US 6,417,615 B1
(45) Date of Patent: Jul. 9, 2002

(54) FLUORESCENT LAMP WITH AUXILIARY AMALGAM SECURED TO SINGLE LEAD WIRE

(75) Inventors: Takeo Yasuda, Kanagawa-ken; Mamoru Ikeda, Tochigi-ken; Junji Hasegawa, Kanagawa-ken; Hidenori Ito, Kanagawa-ken; Fuminori Nakaya, Kanagawa-ken; Yusuke Shibahara, Kanagawa-ken; Toshiyuki Ikeda; Takayuki Fujita, both of Tochigi-ken, all of (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 09/472,506

(22) Filed: Dec. 27, 1999

(30) Foreign Application Priority Data

| | | |
|---|---|---|
| Dec. 28, 1998 | (JP) | 10-374011 |
| Jun. 7, 1999 | (JP) | 11-160201 |
| Sep. 30, 1999 | (JP) | 11-280777 |
| Oct. 29, 1999 | (JP) | 11-310365 |

(51) Int. Cl.[7] ..... H01J 1/62
(52) U.S. Cl. ..... 313/490; 313/623
(58) Field of Search ..... 313/490, 580, 313/620, 623, 548, 550, 551, 573

*Primary Examiner*—Vip Patel
(74) *Attorney, Agent, or Firm*—Pillsbury Winthrop LLP

(57) ABSTRACT

A compact self-ballasted fluorescent lamp (10) which is equivalent to a typical light bulb is provided.

The self-ballasted fluorescent lamp (11) induces a cover (14), a ballast (16), an arc tube (18), a base (12) and a globe (17) and formed into a shape whose outline dimensions are nearly identical to the standard dimensions of a typical light bulb. The arc tube (18) is comprised of a plurality of U-shaped bent bulbs (31) which have an inner tube diameter ranging from 6 to 9 mm and arranged in parallel with one another. Having a bulb height ranging form 50 to 60 mm and a discharge path from 400 to 500 mm, the lamp power is 16 to 23 W. An envelope (19) comprising the cover (14)and the globe (17) has a height ranging from 110 to 125 mm including the height of the base (12). As single lead wire (copper-weld) (54) is sealed with the pinch seal portion (45*b*,45*c*) at position away from the connecting tube (36) of the bulb (31), the thermal effect to which the copper-weld wire (54) is subject when connecting the tubular bodies (33*a*, 33*b*, 33*c*, 33*d*) with the connecting tube (36) is reduce and cracks generated on the pinch seal portion (45) which is the sealed point, as a result of the copper-weld wire (54) heated to a high temperature can be prevented and the yield can be improved.

14 Claims, 8 Drawing Sheets

(a)

(b)

(a)

(b)

FLUORESCENT LAMP WITH AUXILIARY AMALGAM SECURED TO SINGLE LEAD WIRE

This application claims priority from Japanese Patent Application 11-310365 filed Oct. 29, 1999, 11-160201 filed Jun. 7, 1999, 11-280777 filed Sep. 30, 1999 and 10-374011 filed Dec. 28, 1998, the contents of which are incorporated herein by reference.

BACKGROUND OF THE INVENTION

1. Field of the Invention

The present invention relates to self-ballasted fluorescent lamp and compact discharge lamp which are made to an even smaller scale.

2. Description of Related Art

Self-ballasted fluorescent lamps having fluorescent arc tubes are known. Examples of conventionally known self-ballasted fluorescent lamps include a self-ballasted fluorescent lamp which is provided with a cover, a ballast contained in the cover, and an arc tube bent or otherwise formed into an appropriate shape and contained in a globe, said cover having a base that can be mounted in a socket designed for a typical light bulb.

A self-ballasted fluorescent lamp commercially available at present typically has such specifications as a height of approximately 130 mm (including the height of the base), an outer diameter of approximately 70 mm, an outer tube diameter of the arc tube of approximately 12 mm, a discharge path length of approximately 280 mm, a tube wall thickness of not less than 1.1 mm, and a lamp power of approximately 13 W. Due to its configuration, however, it is difficult to provide a fluorescent lamp which has such an arc tube and is as compact as typical light bulb. Nevertheless, there is an increasing demand for fluorescent lamps made to an even smaller scale.

Another example of self-ballasted fluorescent lamps is disclosed in Japanese Patent Laid-open No. 1987-12051, which relates to a fluorescent lamp, wherein an arc tube having three U-shaped bent bulbs is disposed in such a way that the three U-shaped bent bulbs respectively correspond to the three sides of an approximately equilateral square. However, as there is no detailed discussion in the above Japanese Patent Public Disclosure as to various criteria regarding the reduction of the dimensions of the lamp, such as dimensions and the shape of the arc tube as well as criteria for lighting the lamp, the invention disclosed in said publication does not provide the optimum configuration for reducing the dimensions of the lamp.

Another example of fluorescent lamps is disclosed in Japanese Patent Laid-open No. 1987-12051, wherein the arc tube of the fluorescent lamp is formed in a U-like shape having comers bent at approximately 90° C. However, the configuration having such an arc tube, i.e. an arc tube having sharp comers, presents a problem of irregularity in luminance, because the corners of the arc tube are too dose to the globe when the arc tube is contained in the globe which is as small as that of a typical light bulb.

Another example of fluorescent lamps is disclosed in Japanese Patent Laid-open No. 1997-69309, wherein the arc tube is bent into a spiral or other shape so as to produce a lamp having a shape and dimensions nearly identical to those of a typical light bulb. However, a configuration which calls for bending the arc tube into such a complicated shape as a spiral requires a complicated production process and presents a problem in that reduction of production costs is difficult. As it is difficult to put such an arc tube in practical use for reasons described above, an arc tube having U-shaped bent bulbs is normally used. However, a lamp having such an arc tube, too, is difficult to be made compact, because it imposes various limitations in the shape and the dimensions of the U-shaped bent bulbs.

When the dimensions of a fluorescent lamp are reduced, there arises the danger of heat from the arc tube exerting an unfavorable influence on the ballast that is contained in the cover. As a fluorescent lamp disclosed in Japanese Patent Laid-open No. 1996-273615, one of the known ways to solve this problem is a configuration which calls for disposing a circuit board for mounting components of the ballast thereon in such a manner that the components are positioned apart from the ends of the arc tube at which the electrodes are provided. As a result of the reduction of the dimensions of fluorescent lamps, however, circuit boards, too, are made compact. Therefore, the above configuration presents a problem in that the reduction in the space in which the necessary components are mounted increases the planar dimensions of the lamp too much, particularly at the part where the cover is located.

Regarding a self-ballasted fluorescent lamp which is provided with a cover having a base that can be mounted in a socket designed for an incandescent lamp, a ballast contained in the cover, and an arc tube bent or otherwise formed into an appropriate shape and contained in a globe, a configuration which calls for disposing a circuit board at the base facing end of an arc tube that is bent in a U-like shape and arranging electrical components on both end of the circuit board is widely known. One of examples of such configuration is disclosed in Japanese Patent Laid-open No. 1988-245803. Compared with the aforementioned configuration which calls for positioning the circuit board apart from the ends of the arc tube, said configuration disclosed in Japanese Patent Laid-open No. 1988-245803 is more effective in reducing the horizontal dimensions of the lamp at the region of the cover. On the other hand, it presents such problems that interference between the electrical components and the arc tube, especially between the electrical components and the end of the arc tube, increase the influence of heat exerted on the electrical components and that such a configuration makes the lamp too long.

As described above, the outer diameter of the conventional self-ballasted fluorescent lamp has larger than the outer diameter of typical light bulb. Therefore, this configuration presents problem in that it is not suitable for a luminaire which uses a typical light bulb in place of a typical light bulb.

Regarding a fluorescent lamp which is used to a self-ballased fluorescent lamp, a configuration which a bulb has a bent discharge path, which formed by connecting a three U-shaped tubular bodies in series and electrodes disposed at the both ends of the bulb is widely known. One of examples of such configuration is disclosed in Japanese Patent Laid-open No. 220360-1989. And such configuration ensures the length of a discharge path and the reduction of the dimensions of a fluorescent lamp.

In some cases, such a fluorescent lamp uses a main amalgam for controlling the pressure of the mercury vapor in the bulb within an appropriate range during the time that the lamp is lit under normal conditions and an auxiliary amalgam for absorbing mercury floating in the bulb when the lamp is turned off and releasing the absorbed mercury during the early stage of lighting, including the moment when the lighting is initiated. In a configuration where the amalgams are used, the main amalgam is contained in a minute tube which serves to discharge the air and projects from an end, i.e. the end at which an electrode is contained in the bulb, of a tubular body that is located at an end of the bulb, while the auxiliary amalgam is disposed at an end of a tubular body positioned at the middle portion of the bulb. However, when the exhaust minute tube that contains the main amalgam and projects from a tubular body situated at an end of the bulb is located at the same end at which an electrode enclosed in the bulb is located, the temperature of the main amalgam becomes too high due to the influence of the heat from the electrode. Such an increase in the temperature of the main amalgam impairs the effective control of the pressure of the mercury vapor and causes the pressure of the mercury vapor to increase too much, resulting in a decrease in luminous flux This configuration presents another problem in that it is difficult to uniform or stabilize the pressure of the mercury vapor in the tubular body that is located at the other end of the bulb, at a long distance from the main amalgam.

The other example of fluorescent lamps characterized by inclusion of a main amalgam is disclosed in Japanese Utility Model Publication No. 1992-47893, wherein a main amalgam is disposed in a minute tube projecting from an end of one of the four tubular bodies that form the bulb, said tubular body being the middle tubular body of the four tubular bodies. The fluorescent lamp having this configuration is capable of reducing the influence of the heat from the electrodes exerted on the main amalgam, limiting the pressure of the mercury vapor within an appropriate range by preventing an excessive increase in temperature of the main amalgam, and also capable of reducing the distances from the main amalgam to the respective ends of the bulb by a nearly identical degree, thereby making the pressure of the mercury vapor uniform and stable throughout the interior of the bulb. On the other hand, the above configuration presents a problem in that disposing the main amalgam in the minute tube projecting from an end of the middle tubular body of the four tubular bodies of the bulb positions the main amalgam too far from the electrodes, making it difficult to warm the main amalgam. Especially at the initiation of lighting, when both the ambient temperature around the fluorescent lamp and the temperature of the main amalgam itself are low, the main amalgam is slow to release mercury, because it takes a long time for the temperature of the main amalgam to reach the level where the main amalgam functions most effectively. As a result, the luminous flux build-up characteristics become poor, and it takes an excessively long time to stabilize the luminous flux In response to the recent tendency toward compact fluorescent lamps, the demands for reduction of the dimensions of bulbs are on the increase. In the configuration where each minute tube for discharging the air is provided at an end of the bulb, the reduction of the diameter of the bulb makes it necessary to reduce the diameter of the minute tubes. However, a minute tube having a diameter smaller than a given dimension has poor exhaust conductance, resulting in decrease in the exhaust efficiency. On the other hand, if the diameter of the minute tubes are not reduced, the distance between each minute tube and a pair of inner copper-weld wires that support an electrode is reduced, making the operation of sealing the bulb difficult.

Another example of fluorescent lamps characterized by inclusion of a main amalgam and auxiliary amalgam in U.S. Pat. No. 5,739,633, wherein a main amalgam is disposed in a minute tube projecting from an end of one of the four tubular bodies that form the bulb, and auxiliary amalgam is supported by two lead wires in a pinch seal portion of the tube. Thus, this pinch seal portion cause to crack. According to conventional lamp having two copper-weld wires near the connecting tube in the bulb. The two copper-weld wire are received the thermal effect from fire when connecting the tubular bodies with the connecting tube. Thus cracks generated on the pinch seal portion, which is the sealed point, as a result of two copper-weld wires heated to a high temperature.

In order to solve the above problems, an object of the present invention is to provide a discharge lamp and a self-ballasted fluorescent lamp that are characterized by auxiliary amalgam structure so as to prevent the cracking of the pinch seal of the lamp.

SUMMARY OF THE INVENTION

Accordingly, the present invention includes a bulb having a bent discharge path, which is formed by connecting a plurality of tubular bodies in series, the tubular bodies being joined by the connecting tubes for completing said discharge path and a pinch seal portion located near the middle of the discharge path, rare gas hermetically contained in the bulb, electrodes respectively disposed at the two ends of the bulb in such a manner as to be enclosed in the sealed bulb, a main amalgam enclosed in the bulb, several auxiliary amalgams enclosed in the bulb and a structure which support the auxiliary amalgam and having single lead wire enclosed in the pinch seal portion near the connecting tube.

According to the present invention, as one lead wire for the auxiliary amalgam is sealed with the pinch seal at a position away from the connecting tube at the ends of the tubular bodies connected via the connecting tube of the bulb, the thermal effect to which the lead wire is subject when connecting the tubular bodies with the connecting tube is reduced and cracks generated on the pinch seal portion, which is the sealed point, as a result of the lead wire heated to a high temperature can be prevented and the yield can be improved.

Various embodiments of the invention will be described in detail with reference to the drawings.

BRIEF DESCRIPTION OF THE DRAWINGS

The invention will be described in more detail below with reference to the following figures.

Throughout the various figures, like reference numerals designate like or corresponding parts or elements. Duplicative description will be avoided as much as possible.

DETAILED DESCRIPTION OF THE PREFERRED EMBODIMENTS

Preferred embodiments of the present invention will be described with reference to the accompanying drawings.

Figure 1:
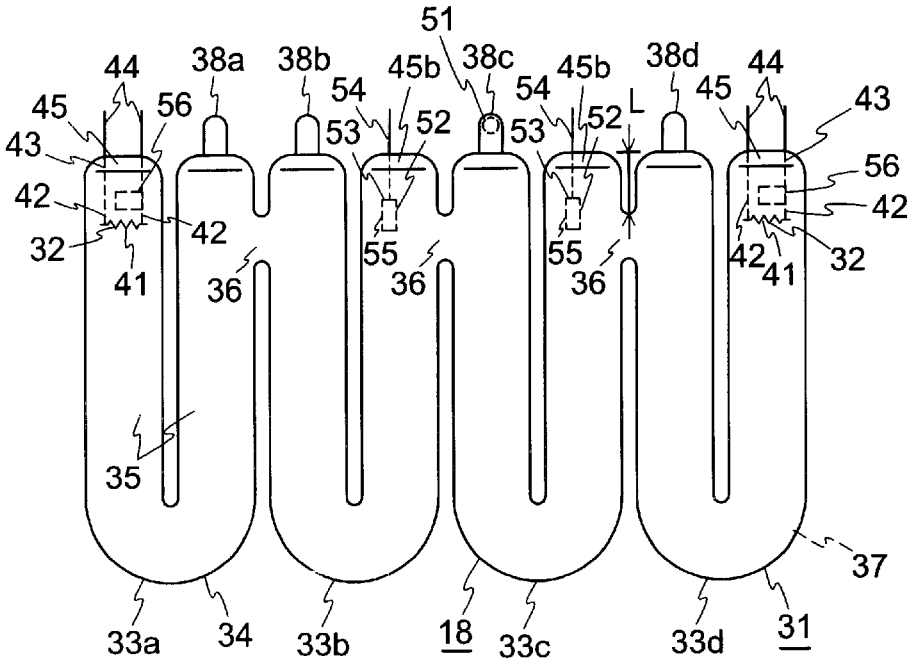
FIG. 1 is an exploded view of a first embodiment of a self-ballasted fluorescent lamp according to the present invention.
Figure 2:
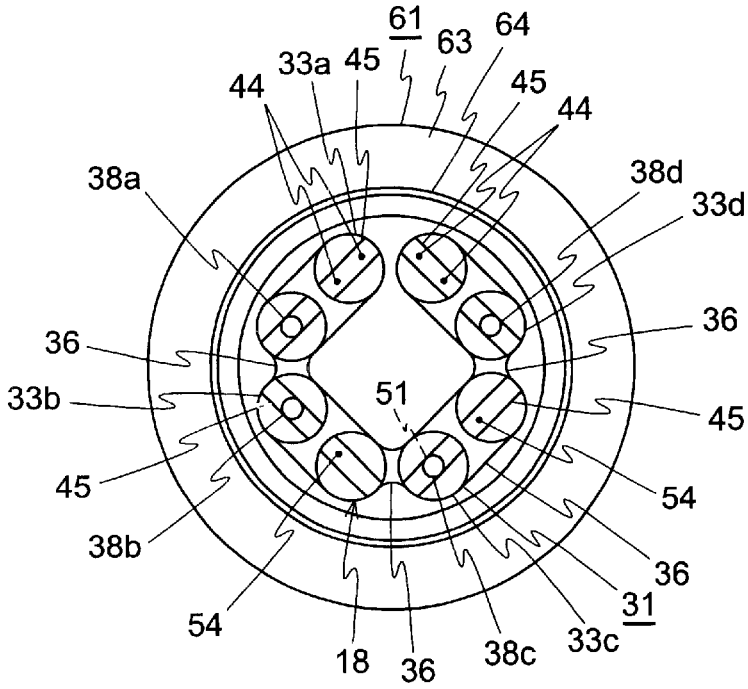
FIG. 2 is a plane view of said self-ballasted fluorescent lamp as viewed from the bottom of the lamp.
Figure 3:
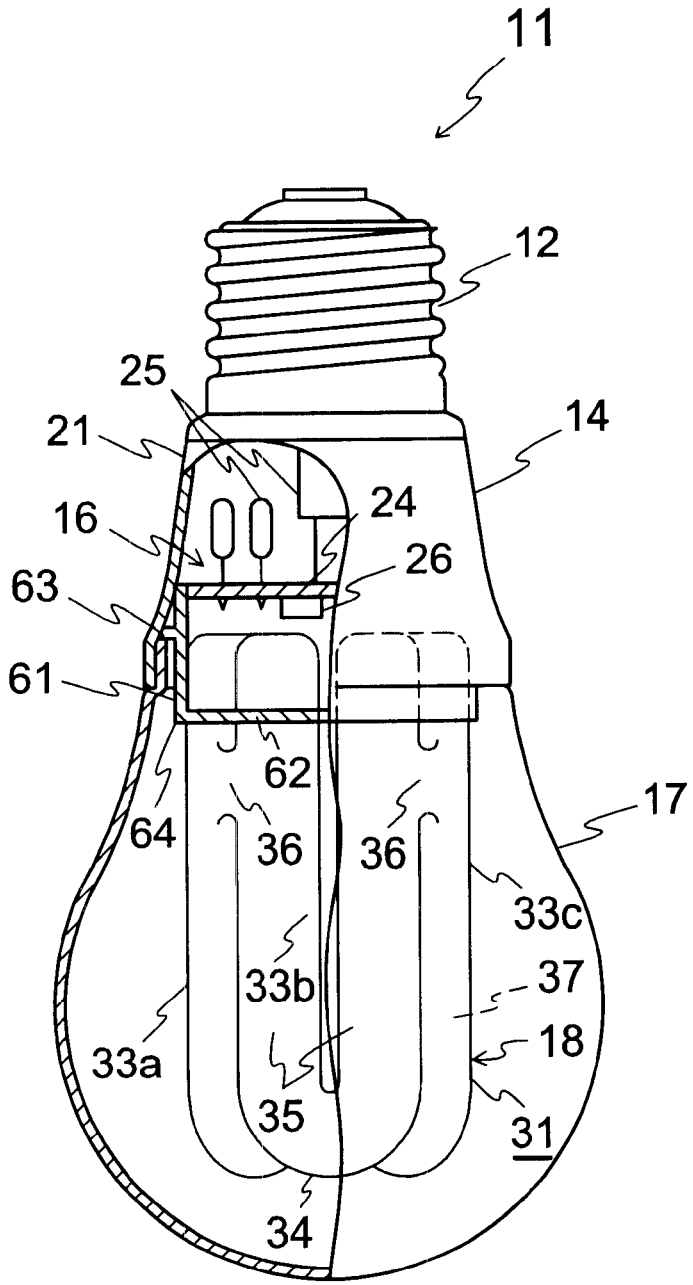
FIG. 3 is a side view of said self-ballasted fluorescent lamp, wherein the globe of said fluorescent lamp is illustrated as if the inside contents were visible, according to the present invention.
Figure 4:
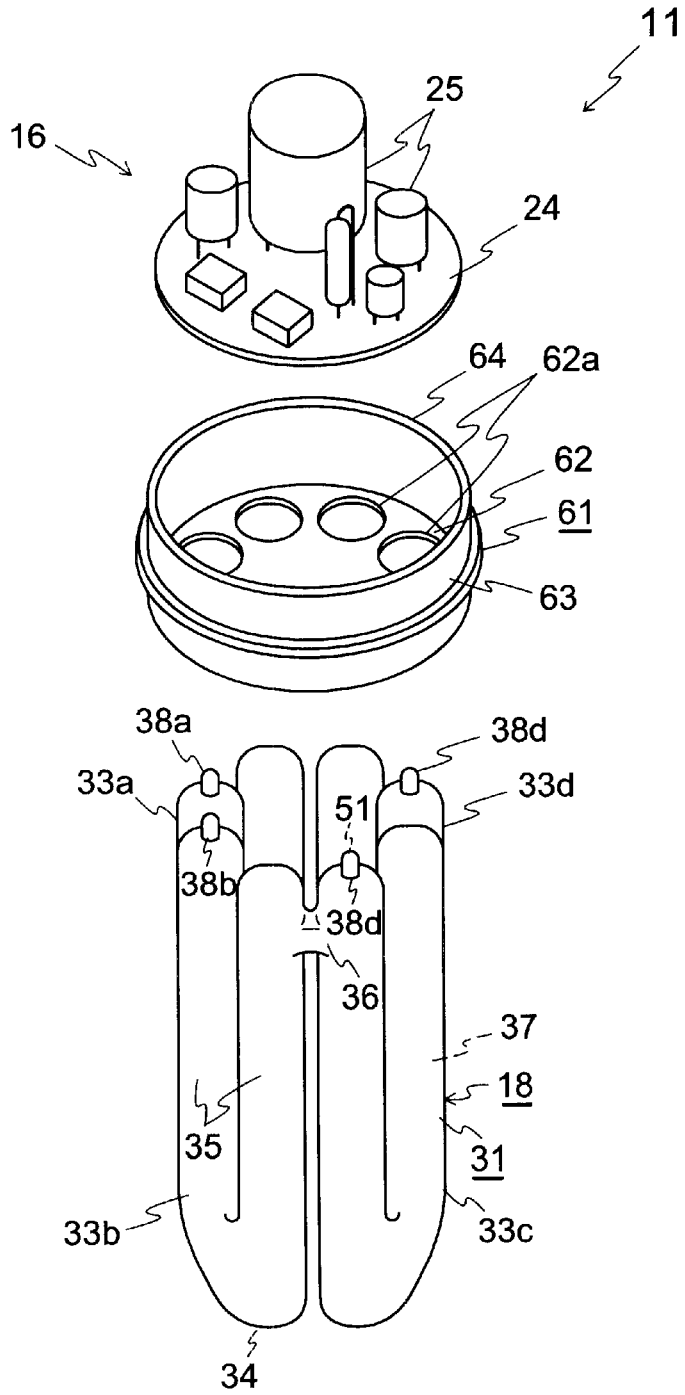
FIG. 4 is a perspective of a part of said self-ballasted fluorescent lamp according to the present invention.
Figure 5:
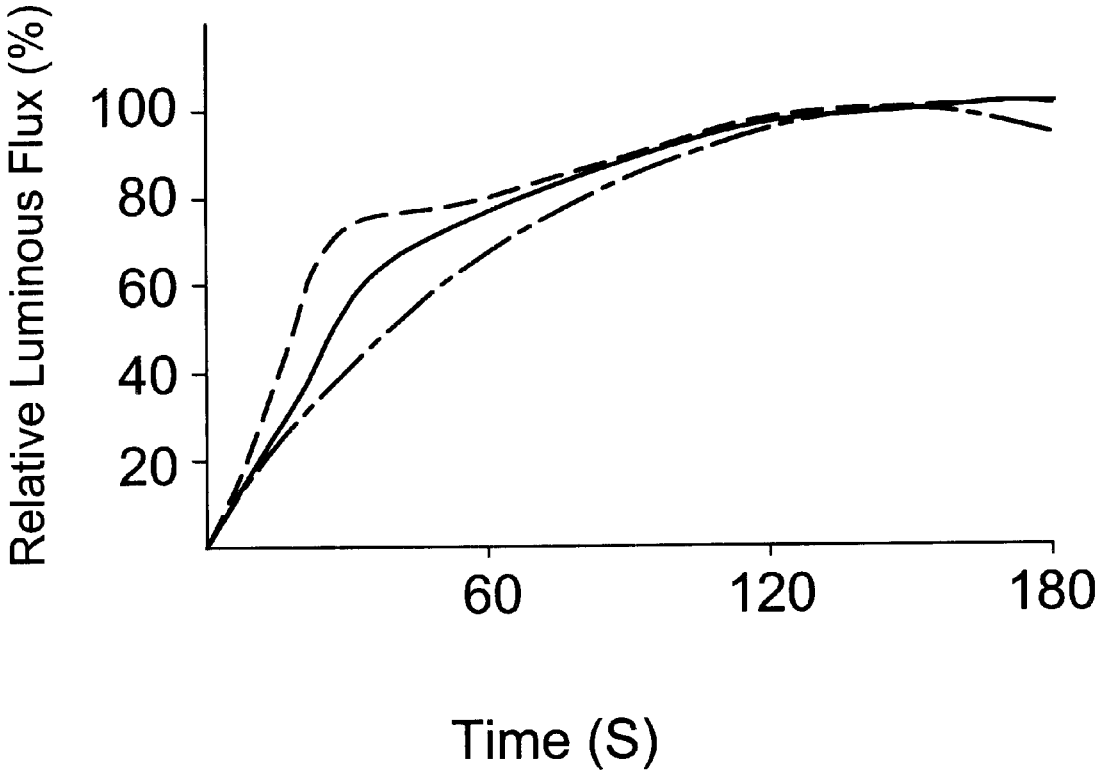
FIG. 5 is a graph showing the relative luminous flux billed-up characteristic.

A first embodiment of the present invention will be explained with reference to FIGS. 1–5. FIG. is an exploded view of a bulb of a self-ballasted fluorescent lamp according to the invention. FIG. 1 is an exploded view of a bulb of said fluorescent lamp; FIG. 2 is an plane view of said fluorescent lamp; FIG. 3 is a top view of same, wherein the globe of said fluorescent lamp is illustrated as if the inside contents were visible; and FIG. 4 is a perspective of a part of said fluorescent lamp; FIG. 5 is a graph showing the relative luminous flux billed-up characteristic;

In the drawings, numeral 11 denotes a discharge lamp having a shape of a light bulb (hereinafter called self-ballasted fluorescent lamp). The self-ballasted fluorescent lamp 11 comprises a cover 14 having an E26-type base 12, a ballast 16 contained in the cover 14, a translucent globe 17, and an arc tube 18 contained in the globe 17. The cover 14 and the globe 17 together form an envelope that has such an outer shape as to have nearly the same dimensions as standard dimensions of a typical light bulb for general illumination. In the type of 60 W, the height of the envelope ranges from approximately 110 to 125 mm including the height of the base 12, for example while the diameter of the envelope. the outer diameter of the globe 17, ranges from approximately 50 to 60 mm. the maximum outer diameter of the cover 14, ranges from approximately 40 mm. In the type of 100 W, the height of the envelope ranges from approximately 125 to 145 mm including the height of the base 12, for example while the diameter of the envelope. the outer diameter of the globe 17, ranges from approximately 65 to 75 mm. The maximum outer diameter of the cover 14, ranges from approximately 50 mm. Further, in the explanation hereunder, the side where the base 12 is located is referred to as the lower side, while the side where the globe 17 is located is referred to as the upper side.

The cover 14 is provided with a cover body 21 that may be formed of a heat resistant synthetic resin such as polybutylene terephthalate (PBT). The cover body 21 has an approximately cylindrical shape that flares upward. The base 12, which may be of the E26-type, is disposed over the bottom of the cover body 21 and fastened thereto by way of bonding, crimping or any other appropriate means.

The globe 17 may be transparent or photo-diffusing milky white. The globe 17 is formed of glass, synthetic resin or the like into a smoothly curved shape nearly identical to the glass bulb of a light bulb, with the edge of its opening fitted in an opening at the top of the cover 14 and fastened thereto. The luminance of the lamp may be made more uniform by forming the globe 17 in combination with another member, such as a diffusion film.

A combination of such a globe 17 as described above and a bulb 31, which will be described later, increases the output power of the light irradiated in the direction of the base 12 and thereby achieves luminous intensity distribution whose characteristics are similar to those of a light bulb for general illumination.

The ballast 16 is comprised of a high-frequency inverter circuit for lighting the arc tube 18 at a high frequency. The ballast 16 consists of an approximately disk-shaped board on which electronic components are mounted. The maximum outer diameter of the ballast 16 is 40 mm.

The arc tube 18 has a bulb 31. A film of phosphor is formed on the inner surface of the bulb 31. The bulb 31 hermetically contains rare gas, such as argon and mercury. The bulb 31 also contains a pair of electrodes 31, which are respectively disposed at the two ends of the bulb 31.

The bulb 31 has four tubular bodies 33*a*, 33*b*, 33*c*, 33*d* each of which may be an approximately cylindrical glass tube having an outer tube diameter ranging from 8 to 11 mm and an inner tube diameter ranging from 6 to 9 mm and a wall thickness ranging from 0.7 to 1.0 mm, and formed into a smoothly curved U-like shape having a crown by bending said glass tube at the middle of its length, which ranges from approximately 110 to 130 mm. Therefore, each tubular body 33*a*,33*b*,33*c*,33*d* has a bent portion 34 that is smoothly turned back on itself and a pair of straight portions 35 extending parallel to each other and integrally connected to the respective two ends of the bent portion 34.

The two ends of the tubular body 33*b*,33*c* which is located at the middle part of the bulb 31, are respectively connected through connecting tubes 36 to one end of the tubular body 33*a* and one end of the tubular body 33*d*, which are respectively located at the ends of the bulb 31, so that a single continuous discharge path 37 having a length ranging from 200 to 300 mm is formed. In the state where the bulb 31 is incorporated in the self-ballasted fluorescent lamp 11, the crowns (the bent portions 34) of the tubular bodies 33*a*,33*b*,33*c*,33*d* are aligned at regular intervals in a circle whose center is on the central axis of the self-ballasted fluorescent lamp 11 extending in the vertical direction, and the straight portions 35 of the tubular bodies 33*a*,33*b*,33*c*, 33*d*, too, are aligned at regular intervals in a circle whose center corresponds to the central axis of the lamp. To be more specific, the straight portions 35 of each tubular body 33*a*,33*b*,33*c*,33*d* are arranged along each respective side of a square that forms a cross section of the bulb 31. The straight portions 35 aligned in a circle are formed so that the distance between each straight portion 35 and its adjacent straight portion 35 is shorter than the outer diameter of each tubular body 33*a*,33*b*,33*c*,33*d*.

The tubular bodies 33*a*,33*b*,33*c*,33*d* are respectively provided with cylindrical minute tubes 38*a*,38*b*,8*c*,38*d* that may be called exhaust tubes. Each minute tube 38*a*,38*b*,38*c*,38*d* communicates with the corresponding tubular body 33*a*, 33*b*,33*c*,33*d* and projects from an end thereof. However, each one of the minute tubes 38*a*,38*d* of the tubular bodies 33*a*,33*d*, which are respectively located at the two ends of the bulb 31 projects from the non electrode end. the end opposite the end at which an electrode 31 is attached. The air is discharged from the bulb 31 through the minute tubes 38*b*, while the rare gas is introduced. After the rare gas has replaced the air, the bulb 31 is sealed by fusing the minute tubes 38*b*.

A main amalgam 51 is enclosed in the minute tube 38*a* (or the 38*c*), when the minute tube is sealed. The main amalgam 51 is an alloy of bismuth, indium and mercury formed into a nearly spherical shape whose diameter is greater than that of the open end portion of the minute tube 38*a* and has the function of controlling the pressure of the mercury vapor in the bulb 31 within an appropriate range. The main amalgam 51 may be formed of an alloy that consists of tin and lead in addition to bismuth and indium.

If it is necessary, an auxiliary amalgam may be disposed in the bulb 31 so as to absorb mercury floating in the bulb when the lamp is turned off, and release the absorbed mercury during the early stage of lighting including the moment when the lighting is initiated.

Each electrode 31 has a filament coil 41 supported by a pair of copper-weld wires (lead wires) 42, each of which is fixed by a dumet wire 43 attached to the glass of the end of the corresponding tubular body 33*a*,33*d* and thus sealed in the tubular body, each copper-weld wire 42 is connected to a wire 44 that is drawn out of each respective tubular body 33*a*,33*d*. Each dumet wire 43 is enclosed in the bulb by means of a pinch seal portion 45 provided at the end of the bulb. When the bulb 31 is installed in a self-ballasted fluorescent lamp 11, the wires 44 are connected to the ballast 16.

Tubular body 33*a*,33*b*,33*c*,33*d* having pinch seal portion 45(includes 45*b*,45*c*) which length is 2 mm to 8 mm. Because under the 2 mm easy to leak of discharge gas of the lamp when having auxiliary amalgam lead wire. Over the 8 mm easy to crack of the pinch seal portion 45 which having auxiliary amalgam lead wire and the length of the lamp became height. The connecting tubes 36 are formed by joining the apertures of the tubular bodies to one another. Said apertures are formed prior to the sealing of the minute tubes 38*a*,38*b*,38*c*,38*d*, by heating and melting the tubular bodies and then breaking through the appropriate portions by blowing air through the tube walls.

The auxiliary amalgam 52 has the base 53 which is a rectangular shaped long plate made of, for instance, SUS in the axial direction of the tubular bodies 33*b* or 33*c*. One end of this base 53 is welded to the copper-weld wire 54 (which is single lead wire for the auxiliary amalgam) as a nickel (Ni) made linear supporting member. The base 53 is applied with a metallic plating 55 of indium (In) which adsorbs mercury at a point separated from the point welded to the copper-weld wire. When the lamp is lit, indium contained in the metallic plating 55 applied to a point separated from the welded point to the copper-weld wire is fused and reaches the copper-weld wire 54 and therefore, an alloy is produced through the reaction of nickel in the copper-weld wire 54 with indium, and the drop of the luminous flux billed-up characteristic caused when the lamp is lit at a certain interval of time can be prevented.

The copper-weld wire 54 of the auxiliary amalgam 52 is formed in a diameter less than that of the copper-weld wire 42 of the electrode 32 and sealed at the eccentric positions of the ends of the tubular bodies 33*b*, 33*c* away from the connecting tube 36 from the center of the tubular bodies 33 by the pinch seal portion 45.

The diameter of the copper-weld wire 54 is made thinner than that of the copper-weld wire 42 of the electrode 32 and the copper-weld wire 54 is separated from the connecting tube 36. Thus, when the tubular bodies 33*a*,33*b*,33*c*,33*d* are connected with the connecting tube 36, the thermal effect to which the copper-weld wire 54 is subject is reduced, the copper-weld wire 54 becoming to a high temperature and cracks generated on the pinch seal portion 45 at the sealing point are prevented.

The copper-weld wire 54 is formed in a diameter in a range of 0.2~0.4 mm as the mechanical strength is insufficient when the diameter is less than 0.2 mm and the reduction of thermal effect is not sufficient when the diameter is more than 0.4 mm.

The auxiliary amalgam 56 is in a structure similar to the auxiliary amalgam 52 and has the similar mercury vapor pressure characteristic. Further, the distance between the pinch seal portions 45 that are the ends of the tubular bodies 33*b*, 33*c* where the auxiliary amalgam 52 of the bulb 31 is disposed and the connecting tube 36 is formed in a range from 8 mm to 15 mm. When thus defined, the thermal effect to which the copper-weld wire 54 is subject when connecting the tubular bodies 33*a*,33*b*,33*c*,33*d* with the connecting tube 36 is reduced so that the copper-weld wire 54 is prevented to increase to a high temperature and cracks generated on the pinch seal portion 45, which is the sealed point, can be prevented. If the distance L is less than 8 mm, the copper-weld wire is apt to be subject to the thermal effect and more than 15 mm, the length of the discharge path becomes short and luminous efficacy drops.

According to this embodiment, as one copper-weld wire 54 is sealed with the pinch seal portion 45*b*,45*c* at a position away from the connecting tube 36 at the ends of the tubular bodies 33*b*, 33*c* connected via the connecting tube 36 of the bulb 31, the thermal effect to which the copper-weld wire 54 is subject when connecting the tubular bodies 33*a*,33*b*,33*c*, 33*d* with the connecting tube 36 is reduced and cracks generated on the pinch seal portion 45, which is the sealed point, as a result of the copper-weld wire 54 heated to a high temperature can be prevented and the yield can be improved.

Furthermore, as a distance between the pinch seal portion 45 at the ends of the tubular bodies 33*b*, 33*c* where the auxiliary amalgam 52 of the bulb 31 is disposed is defined in a range of 8~15 mm, the thermal effect to which the copper-weld wire 54 is subject when connecting the tubular bodies 33*a*,33*b*,33*c*,33*d* with the connecting tube 36 is reduced and cracks generated on the pinch seal portion 45, that is the sealed point, as a result of the copper-weld wire 54 heated to a high temperature can be prevented and the yield can be improved.

Further, as the diameter of one copper-weld wire supporting the auxiliary amalgam in the discharge path 37 of the bulb 31 is made narrower than the diameter of the copper-weld wire 42 of the electrode 32, the thermal effect to which the copper-weld wire 54 is subject when connecting the tubular bodies 33*a*,33*b*,33*c*,33*d* with the connecting tube 36 is reduced, cracks that are generated on the pinch sealed point as a result of the copper-weld wire 54 heated to a high temperature can be prevented and the yield can be improved.

Furthermore, as the diameter of the copper-weld wire 54 is defined to a range of 0.2 mm to 0.4 mm, it becomes possible both to reduce thermal effect on the copper-weld wire 54 and secure the strength of the wire. Further, the whole copper-weld wires 54 can be in the same diameter; however, at least the sealed portions at the ends of the tubular bodies 33*b*, 33*c* can be in a range of 0.2 mm to 0.4 mm and other portions may be outside this range and the diameter can be made larger to secure the strength.

Figure 6:
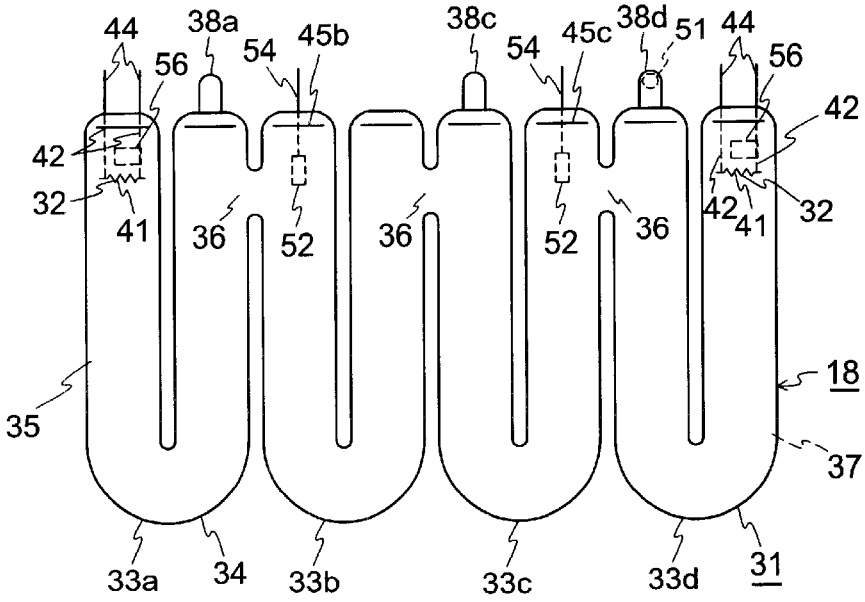
FIG. 6 is illustrates a self-ballasted fluorescent lamp, wherein (a) is an exploded view of a bulb according to the other embodiment of the present invention, and (b) is an exploded view of a bulb of a conventional fluorescent lamp.
Figure 6:
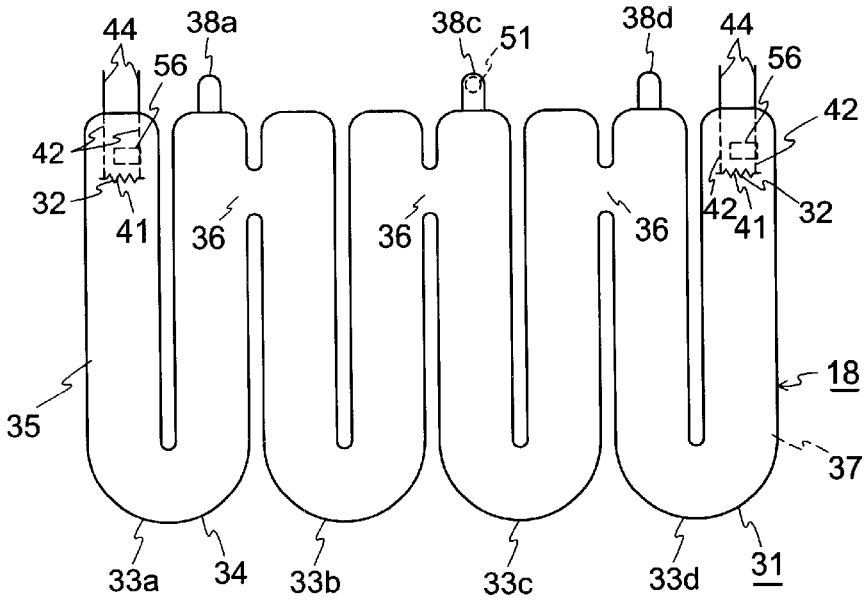

The main amalgam 51 is disposed at the end of the tubular body 33*c* that is put between the auxiliary amalgams 52 in the discharge path of the bulb 31, the mercury vapor in the bulb 31 returning to the main amalgam 5l when the lamp is turned off can be adsorbed in a well-balanced manner, mercury vapor can be discharged uniformly and satisfactorily from the auxiliary amalgams when the lamp is turned on and the lamp can be lit at an uniform luminance. Further, two auxiliary amalgams 52 are disposed at almost uniform positions lengthwise of the discharge path 37 of the bulb 31, that is, the intermediate tubular bodies 33, 33*c* without electrodes 32 provided and four auxiliary amalgams 52, 56 are disposed almost uniformly, mercury vapor from these auxiliary amalgams 52, 56 can be uniformly discharged to the whole discharge path 37 and the luminous flux billed-up characteristic when starting the lamp can be improved. The measured results of the relative luminous flux billed-up characteristics are shown in FIG. 5. The luminous flux billed-up characteristic A is in this embodiment wherein the main amalgam 51 is disposed to the intermediate tubular body 33*b* and the auxiliary amalgams 52, 56 to the tubular bodies 33*a*,33*b*,33*c*,33*d*. The luminous flux billed-up characteristic B is in other embodiment wherein the main amalgam 51 is disposed at the end opposite the electrode 32 of the tubular body 33*a* from the structure of this embodiment as shown in FIG. 6(*a*). The luminous flux billed-up characteristic C is in a comparison example wherein the auxiliary amalgams 52 of the intermediate tubular bodies 33*b*, 33*c* are omitted from the structure of this embodiment as shown in FIG. 6(*b*). As the result of comparison, the luminous flux billed-up characteristics A, B are improved when compared with the luminous flux billed-up characteristic C.

Further, as in the embodiment shown in FIG. 1, the auxiliary amalgams 52 are disposed at the ends that have not a minute tube 38*b* of the tubular body 33*b* connected via the connecting tube 36 to the end of the tubular body 33*c* to which the main amalgam 51 is disposed, when mercury vapor returns from the tubular body 33*b* of the bulb 31 to the main amalgam 51 through the connecting tube 36, mercury vapor easily adsorbs to the auxiliary amalgam 52, and mercury vapor is discharged satisfactorily from the auxiliary amalgam 52 when starting the lamp and the luminous flux billed-up characteristic can be improved.

Further, as in the embodiment shown in FIG. 6(*a*), the main amalgam 51 is disposed at the end opposite to the end of the tubular body 33*d* in which the electrode 32 of the bulb 31 is sealed and the auxiliary amalgam 52 in the discharge path is disposed at the end of the tubular body 33*c* connected via the connecting tube 36 to the end of the tubular body 33*d* in which the main amalgam 51 is disposed, mercury vapor in the bulb 31 returning to the main amalgam 51 when the lamp is turned off can be much adsorbed to the auxiliary amalgam 52 adjacent to the main amalgam 51 and furthermore, as the main amalgam 51 is near the electrode 32, mercury is evaporated and diffused at an early stage by the effect of the heat generation of the electrode 2, and the luminous flux billed-up characteristic at the time of start can be improved.

Further, as the auxiliary amalgam 52 is formed long along the axial direction of the tubular bodies 33*b*, 33*c*, it is possible to secure the function of the auxiliary amalgam 52, make the shadow of the auxiliary amalgam 52 to hardly cast the auxiliary amalgam 52 is prevented from contacting the inner walls of the tubular bodies 33*b*, 33*c* from manufacturing error and the like, and to cope with achieving the bulb 31 in a small diameter.

Further, as the metallic plating 55 is applied to points except the welded points of the copper-weld wire 54 of the auxiliary amalgam 52 to adsorb mercury, it is possible to prevent the mercury vapor pressure characteristic from being impaired as a result of the metallic plating 55 flowing to and reacting with the copper-weld wire 54, and maintain the luminous flux billed-up characteristic to the end of life.

Further, when the auxiliary amalgams 52 in the discharge path are disposed in a distance 15 mm to 25 mm from the ends of the tubular bodies 33*b*, 33*c*, the auxiliary amalgams 52 can be disposed in the discharge path 37, mercury vapor in the discharge path 37 can be much adsorbed to the auxiliary amalgams 52 when the lamp is turned off, and the luminous flux billed-up characteristic at the time of start may be improved.

Figure 7:
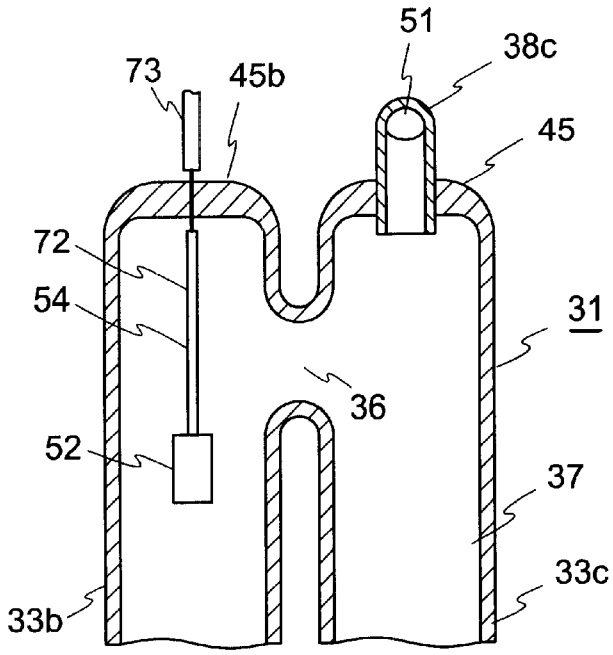
FIG. 7 is a side view of a partially-cutaway of a self-ballasted fluorescent lamp according to the other embodiment of the present invention.
Figure 8:
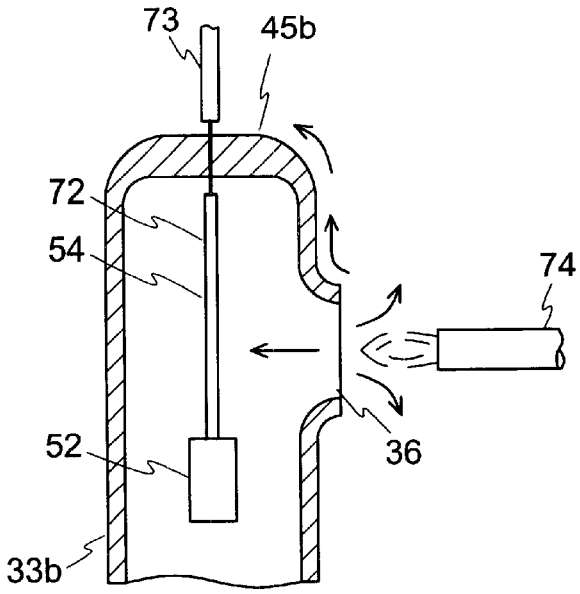
FIG. 8 is a cross sectional view of a self-ballasted fluorescent lamp according to the other embodiment of the present invention.

Further, in the case of a 100 W bulb type fluorescent lamp 11, it has an arc tube 18 with the tube inner diameter 6 mm to 9 mm, the discharge path length 400 mm to 500 mm, power consumption 16 W to 23 W ,and the fluorescent material layer formed on the inner surface of the bulb 31, a ballast 16 connected to the arc tube 18, a cover 14 which supports the arc tube 18 and houses the ballast 16, a base 12 mounted to the cover 14 and an envelope in a height 125 mm to 145 mm including the base 12, and therefore, by disposing the down sized arc tube 18 largely to the height dimension, it is possible to make the bulb type fluorescent lamp 11 in a small size and the brightness of 1000 lm to 1600 lm equivalent to incandescent electrodes of 80 W to 100 W can be obtained at the power consumption of the arc tube 18 ranging from 16 W to 23 W and thus, it is possible to achieve the power saving. Further, as shown in FIG. 7 and FIG. 8, the copper-weld wire 54 which supports the auxiliary amalgams may be composed of a sealing portion 71 that is sealed to the pinch seal portion 45 of the tubular body 33*b*, a supporting portion 72 that supports the auxiliary amalgam 52 by entering into the tubular body 33*b* from one end of this sealing portion 71, and a lead-out portion 73 that is led out to the outside of the tubular body 33*b* from the other end of the sealing portion 71 in one line shape. The sealing portion 71 is made of, for instance, an alloy of iron and nickel, applied with the copper plating on the surface, in the diameter ranging from 0.2 to 0.4 mm and formed in about 0.3 mm. The supporting portion 72 and the lead-out portion 73 are made of, for instance, iron, applied with the copper plating on the surface and in the diameter of about 0.5 mm that is thicker than the sealing portion 71. This copper-weld wire 54 is sealed to nearly the center of the end of the tubular body 33*b* by pincher which is pinching machine (unshown). One copper-weld wire 54 supporting the auxiliary amalgam 52 is sealed nearly at the center of at least one tubular body 33*b* connected via the connecting tube 36 of the bulb 31 by the pinch seal, a distance between the copper-weld wire 54 and the tube wall of the tubular body 33*b* is made nearly uniform so that the copper-weld wire 54 is disposed most away from the tube wall and furthermore, as the diameter of the sealing portion 71 of the copper-weld wire is defined to a range of 0.2~0.4 mm, it is possible to secure the strength of the copper-weld wire 54, reduce the effect of the heat conduction to the sealing portion 71 of the copper-weld wire 54 along the tube wall of the tubular body 33*b* when the tube wall of the tubular body 33*b* is fused by overheating with a burner 74 and a point of the connecting tube 36 is blown through and connected, cracks generated on the pinch seal portion 45 that is a sealing point of the tubular body 33*b* to seal the copper-weld wire 54 can be reduced as shown in FIG. 8. In addition, as the copper-weld wire is sealed to nearly the center of the end of the tubular body 33*b* without using such other parts as a dummy stem and the like, it is possible to make the sealing process of the copper-weld-wire 33*b* easily and make the shadow of the auxiliary amalgam 52 hard to cast.

Figure 9:
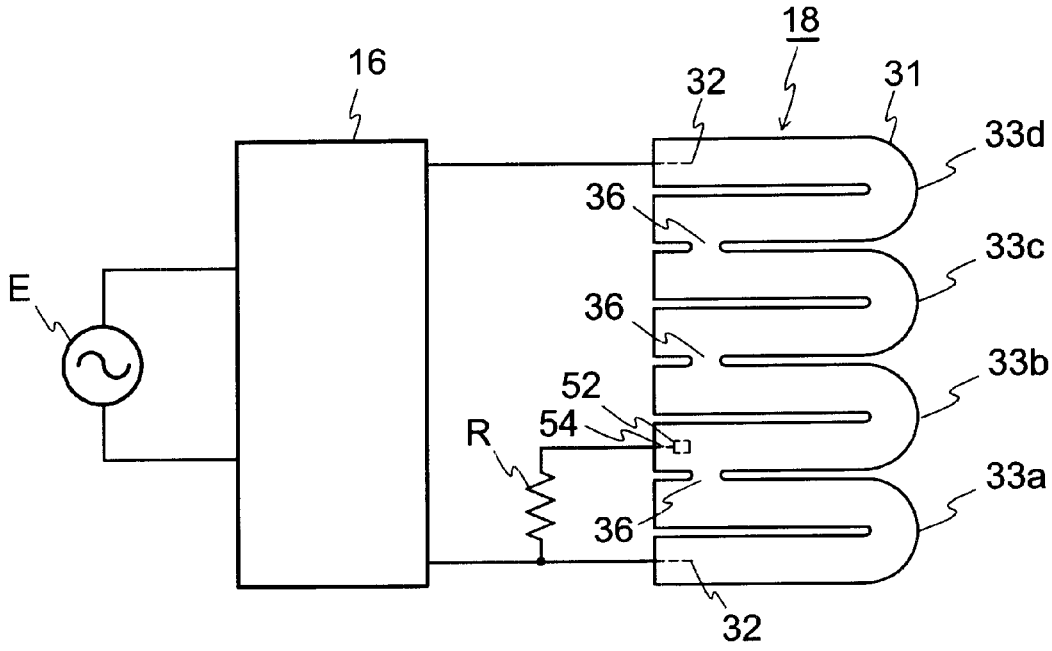
FIG. 9 is a circuit diagram showing the other embodiment of a self-ballasted fluorescent lamp of the present invention.

Further, as shown in FIG. 9, when the copper-weld wire 54 for supporting the auxiliary amalgam in the discharge path is connected to one end of the output of the ballast 16 comprising an inverter circuit connected to the electrodes 32 at both ends of the arc tube 18 via such a high impedance element R as a resistor, the discharge is generated between the copper-weld circuit 45 and the electrode 32 connected to the other end of the output of the ballast 16, the auxiliary amalgam 52 is subject to the ion bombardment as a cold cathode and is quickly heated and further, the discharge expands to the electrode 32 connected to one end of the output of the ballast 16 when the lamp is turned on and therefore, mercury is discharged satisfactorily from the auxiliary amalgam in the discharge path and the luminous flux billed-up characteristic when the lamp is turned on can be improved. Furthermore, as the starting property is improved and the starting voltage drops in this case, it becomes possible to use component parts in small capacity the ballast 16 and make it in small size.

Figure 10:
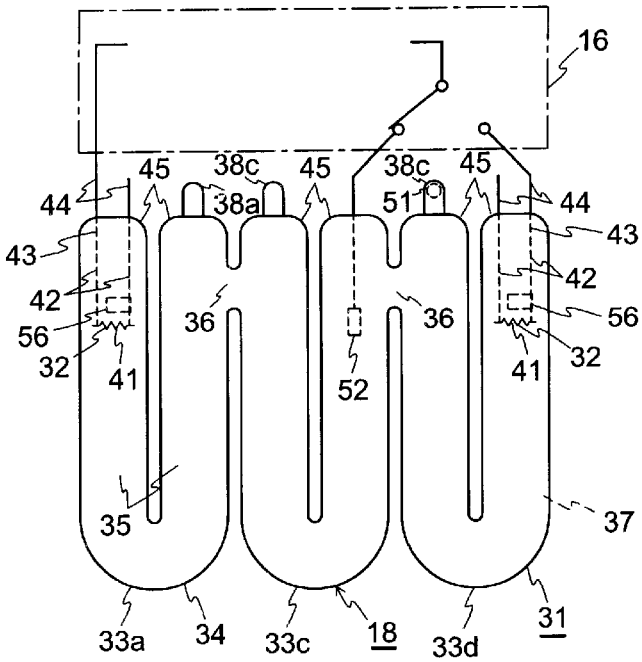
FIG. 10 is illustrates a circuit diagram showing the other embodiment of a self-ballasted fluorescent lamp of the present invention, wherein (a) is starting mode of the circuit, and (b) is operating mode of the circuit.
Figure 10:
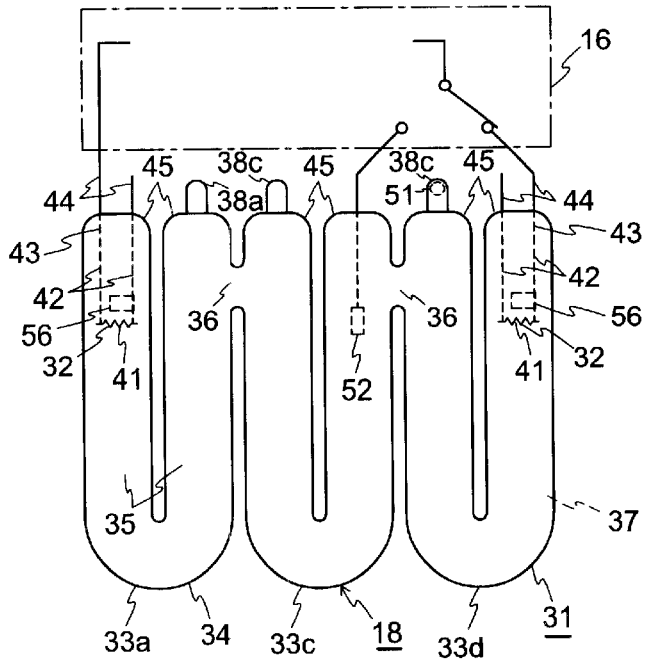

Further, as shown in FIG. 10(*a*) and 10(*b*), high voltage, for instance, about 1 kV is applied between the electrode 32 of the arc tube 18 and the auxiliary amalgam 52 in the discharge path when the lamp is turned on, the auxiliary amalgam 52 is subject to the ion bombardment as a cold cathode and heated in a moment so as to discharge between the electrodes 32 at both ends. Thus, as the auxiliary amalgam 52 in the discharge path is heated in a moment and mercury is discharged satisfactorily at the time of starting the lamp, the luminous flux billed-up characteristic at the time of staring can be improved.

Further, a time of about 100 msec. is sufficient for applying high voltage to the auxiliary amalgam 52 in the discharge path and even when the electrode 32 at the other end shifts to the arc during this period, there is no problem. Further, a series of these operations are made in several hundred msec. and the electrodes 32 and the auxiliary amalgams 52 in the discharge path will never be damaged.

Further, a lamp equipped with 3 tubular bodes 33*a*, 33*c*, 33*d* is shown in FIG. 10(*a*) and 10(*b*). A lamp equipped with 4 tubular bodies 33*a*,33*b*,33*c*,33*d* to 33*d* is also similar to this lamp.

When the bulb 31 is equipped with 4 tubular bodies 33*a*,33*b*,33*c*,33*d*, the auxiliary amalgams 52 may be disposed to either one of the intermediate tubular bodies 33*b*, 33*c* only.

The main amalgams 51 may be disposed to any one of the small tubes 38*a*, 38*b*, 38*c*, 38*d* or more of them. When disposing the main amalgam 51 to any one of the small tubes 38*a*, 38*b*, 38*c*, 38*d* it should be positioned between the auxiliary amalgams 52 in the discharge path or between the auxiliary amalgam 52 and the auxiliary amalgam 56 at the electrode side, and when a plurality of main amalgams 51 are disposed to a plurality of minute tubes 38*a*,38*b*,38*c*,38*d*, the auxiliary amalgams 52 in the discharge path are disposed between a plurality of main amalgams 51, the luminous flux billed up characteristic can be improved.

Further, in the above-mentioned embodiments, the arc tube is constructed by connecting 4 or 3 U-shaped tubular bodies. The shape of the arc tube is not restricted to this and for instance, H-shaped tubular bodies are usable or the lamp may be composed by connecting 2 or more than 6 tubular bodies.

Further, though the ballast 16 is constructed by disposing one sheet of circuit board horizontally, a plurality of circuit boards can be provided.

While the invention has been described in connection with what are presently considered to be the most practical and preferred embodiments, it is to be understood that the invention is not limited to the disclosed embodiments. On the contrary, it is intended to cover various modifications and equivalent arrangements included within the spirit and scope of the appended claims.

What is claimed is:

1. A compact discharge lamp comprising:

a bulb having a bent discharge path, which is formed by connecting a plurality of tubular bodies in series, the tubular bodies being joined by connecting tubes for completing said discharge path and a pinch seal portion located near the middle of the discharge path;

rare gas hermetically contained in the bulb;

a pair of electrodes respectively disposed at the ends of the bulb;

a main amalgam enclosed in the bulb;

a auxiliary amalgam enclosed in the bulb; and a single lead wire, which supports the auxiliary amalgam, is fixed in the pinch seal portion near the connecting tube.

2. A compact discharge lamp as claimed in claim 1, wherein:

the single lead wire is substantially fixed at the axis of the tubular body.

3. A compact discharge lamp as claimed in claim 1, wherein:

the single lead wire is fixed near the axis of the tubular body and differ from the connecting tube.

4. A compact discharge lamp as claimed in claim 1, wherein:

the single lead wire is substantially central of the tubular.

5. A compact discharge lamp as claimed in claim 1, wherein:

the diameter of the single lead wire, which is in the pinch seal portion, less than that of the other portion of the single lead wire.

6. A compact discharge lamp as claimed in claim 1, wherein:

the diameter of the single lead wire, which is in the pinch seal portion, is present in a value between 2 mm and 8 mm.

7. A compact discharge lamp as claimed in claim 1, wherein:

the auxiliary amalgam and the electrode are located a substantially equal distance in the discharge path.

8. A compact discharge lamp as claimed in claim 1, wherein:

the auxiliary amalgam and the main amalgam are located a substantially equal distance in the discharge path.

9. A compact discharge lamp as claimed in claim 1, wherein: the main amalgam is located among the auxiliary amalgams in the bulb.

10. A compact discharge lamp as claimed in claim 1, wherein: the length of the pinch seal portion is 2 mm to 8 mm.

11. A compact discharge lamp as claimed in claim 1, wherein: the auxiliary amalgam having longer portion which is along the axis of the bulb.

12. A compact discharge lamp as claimed in claim 1, wherein: the auxiliary amalgam is located for 15 mm to 25 mm from the pinch seal portion.

13. A self-ballasted fluorescent lamp comprising:

a fluorescent lamp;

a ballast which provides a high frequency current to the fluorescent lamp; and the fluorescent lamp comprising:

a bulb having a bent discharge path, which is formed by connecting a plurality of tubular bodies in series, the tubular bodies being joined by connecting tubes for completing said discharge path and a pinch seal portion located near the middle of the discharge path;

a phosphor coating on inner portion of the bulb;

rare gas hermetically contained in the bulb;

a pair of electrodes respectively disposed at the ends of the bulb;

a main amalgam enclosed in the bulb;

a auxiliary amalgam enclosed in the bulb; and a single lead wire, which supports the auxiliary amalgam, is fixed in the pinch seal portion near the connecting tube.

14. A self-ballasted fluorescent lamp as claimed in claim 13, wherein:

the bulb has tube inner diameter is present in a value between 6~9 mm, the discharge path is present in a value between 400 mm and 500 mm, power consumption is present in a value between 16 W and 23 W , a cover which supports the bulb;

a base mounted to the cover; and a height of the lamp is present in a value between 125 mm and 145 mm including the base.

* * * * *